US007152963B2

(12) United States Patent
Owaki et al.

(10) Patent No.: US 7,152,963 B2
(45) Date of Patent: Dec. 26, 2006

(54) LIQUID JET HEAD AND LIQUID JET APPARATUS

(75) Inventors: Hiroshige Owaki, Nagano-ken (JP); Yoshinao Miyata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 210 days.

(21) Appl. No.: 10/909,840

(22) Filed: Aug. 3, 2004

(65) Prior Publication Data

US 2005/0046678 A1 Mar. 3, 2005

(30) Foreign Application Priority Data

Aug. 4, 2003 (JP) ..... 2003-286192

(51) Int. Cl.
*B41J 2/045* (2006.01)

(52) U.S. Cl. ..... 347/68; 347/71

(58) Field of Classification Search ..... 347/59, 347/68–72; 29/25.35
See application file for complete search history.

(56) References Cited

U.S. PATENT DOCUMENTS 6,505,919 B1 * 1/2003 Mizutani ..... 347/70
6,796,640 B1 * 9/2004 Miyata ..... 347/71
6,808,254 B1 * 10/2004 Sakaida et al. ..... 347/71

FOREIGN PATENT DOCUMENTS

| | | | |
|---|---|---|---|
| JP | 5-286131 | A | 11/1993 |
| JP | 2000-351208 | A | 12/2000 |
| JP | 2003-80703 | A | 3/2003 |
| JP | 2003-127365 | A | 5/2003 |
| JP | 2003-136734 | A | 5/2003 |

* cited by examiner

*Primary Examiner*—An H. Do
(74) *Attorney, Agent, or Firm*—Sughrue Mion, PLLC

(57) ABSTRACT

A liquid jet head includes: a passage-forming substrate provided with at least two rows of pressure generating chambers each communicating with a nozzle orifice; and piezoelectric elements for causing pressure change in the pressure generating chambers. The piezoelectric elements are provided on one side of the passage-forming substrate with a vibration plate interposed therebetween. On a joint plate joined to the piezoelectric element side of the passage-forming substrate, driving ICs for driving the piezoelectric elements are provided in regions facing the respective rows of the pressure generating chambers. For each row of the pressure generating chambers, at least one penetrated hole, in which lead electrodes led from the piezoelectric elements are exposed, is provided in a region of the joint plate, the region corresponding to a region between the rows of the pressure generating chambers. A beam portion is formed between the adjacent penetrated holes.

5 Claims, 4 Drawing Sheets

LIQUID JET HEAD AND LIQUID JET APPARATUS

FIELD OF THE INVENTION

The present invention relates to a liquid jet head and a liquid jet apparatus. The present invention particularly relates to an ink jet recording head and an ink jet recording apparatus wherein part of pressure generating chambers communicating with nozzle orifices for ejecting ink droplets are constituted of a vibration plate; piezoelectric elements are formed on a surface of the vibration plate; ink droplets are ejected using the displacement of the piezoelectric elements.

BACKGROUND OF THE INVENTION

For ink jet recording heads in which part of pressure generating chambers communicating with nozzle orifices for ejecting ink droplets are constituted of a vibration plate and in which the vibration plate is deformed by piezoelectric elements to apply pressure to ink in the pressure generating chambers and thereby to eject ink droplets from the nozzle orifices, two types of ink jet recording heads are in practical use. One uses a longitudinal vibration-mode piezoelectric actuator, which expands and contracts in the axial direction of a piezoelectric element. The other uses a flexural vibration-mode piezoelectric actuator.

In the former type, the capacity of a pressure generating chamber can be changed by bringing an end surface of a piezoelectric element into contact with a vibration plate. A head suitable for high-density printing can be manufactured. However, there is a problem that the manufacturing process is complex for the following reason: this type requires a difficult process of cutting piezoelectric elements into a comb-like shape so as to match the piezoelectric elements with the arrangement pitch of nozzle orifices, and also work of fixing the cut piezoelectric elements while positioning them to the pressure generating chambers.

On the other hand, in the latter type, piezoelectric elements can be formed on a vibration plate by a relatively easy process of adhering a green sheet of a piezoelectric material in accordance with the shapes of pressure generating chambers and baking the green sheet. However, there is a problem that a certain area is needed because of the utilization of flexural vibration and that high-density arrangement is difficult.

Meanwhile, in order to eliminate the disadvantage of the latter recording head, a recording head has been proposed in which a uniform piezoelectric material layer is formed over the entire surface of a vibration plate by deposition technology and in which piezoelectric elements are independently formed for respective pressure generating chambers by cutting the piezoelectric material layer into shapes corresponding to the pressure generating chambers by lithography (for example, refer to Japanese Unexamined Patent Publication No. Hei 5(1993)-286131 (FIGS. 1 to 4)).

Such ink jet recording heads include one having a structure which has a passage-forming substrate and a joint plate joined to the piezoelectric element side of the passage-forming substrate. The passage-forming substrate is provided with at least two rows of pressure generating chambers communicating with nozzle orifices. On the joint plate, a driving IC for driving piezoelectric elements is mounted. In this structure, the driving IC is mounted in an approximately central portion of the joint plate, i.e., in a region corresponding to a region between the rows of the pressure generating chambers. The driving IC and lead wires led from the respective piezoelectric elements are electrically connected by wire-bonding through penetrated holes which are respectively formed along both sides of the driving IC on the joint plate (for example, refer to Japanese Unexamined Patent Publication No. 2003-136734 (FIGS. 1 and 2)).

In such a known ink jet recording head, the manufacturing cost can be kept relatively low because two rows of piezoelectric elements are driven by one driving IC. However, since the penetrated holes are respectively formed on both sides of the driving IC, the areas of the passage-forming substrate and the joint plate need to be made relatively large, and it is difficult to miniaturize the head. In particular, when the pressure generating chambers are arranged at high density, there is a problem that regions for forming a plurality of penetrated holes are difficult to ensure and that the size of a head increases. Note that, of course, such problems exist not only in ink jet recording heads for ejecting ink but also in other liquid jet heads for ejecting liquid droplets other than ink.

SUMMARY OF THE INVENTION

In light of the above-described circumstances, an object of the present invention is to provide a liquid jet head and a liquid jet apparatus in which pressure generating chambers can be arranged at high density and of which miniaturization can be achieved.

In order to achieve the above object, a first aspect of the present invention is a liquid jet head including a passage-forming substrate provided with at least two rows of pressure generating chambers each communicating with a nozzle orifice, and piezoelectric elements for causing pressure change in the pressure generating chambers, the piezoelectric elements being provided on one side of the passage-forming substrate with a vibration plate interposed therebetween. This liquid jet head has a joint plate joined to the piezoelectric element side of the passage-forming substrate, and driving ICs for driving the piezoelectric elements, the driving ICs being provided in regions on the joint plate, the regions facing the respective rows of the pressure generating chambers. In the joint plate, at least one penetrated hole, in which lead electrodes led from the piezoelectric elements are exposed, is provided for each row of the pressure generating chambers, in a region corresponding to a region between the rows of the pressure generating chambers, and a beam portion is formed between the adjacent penetrated holes.

In the first aspect, even if the pressure generating chambers are arranged at high density, the head can be miniaturized by utilizing an existing space to form the penetrated holes without providing a space for forming the penetrated holes. Moreover, the provision of the beam portion between the penetrated holes increases the strength of the joint plate, and therefore makes it possible to ensure the rigidity of the passage-forming substrate to which the joint plate is joined. Thus, crosstalk due to the structure can be prevented, and stable ejecting characteristics can be always obtained.

A second aspect of the present invention is the liquid jet head of the first aspect wherein a wiring pattern on which the driving ICs are to be mounted is formed on the joint plate, and wherein a common electrode interconnection constituting part of the wiring pattern is formed along the row of the pressure generating chambers, on the beam portion. Here, the common electrode interconnection is connected to a common electrode common to the plurality of piezoelectric elements arranged parallel to each other.

In the second aspect, the increase in the area of the common electrode interconnection results in the substantial decrease in the ohmic value of the common electrode when voltage is applied to the piezoelectric elements, and therefore the occurrence of a voltage drop can be prevented even if the plurality of piezoelectric elements are simultaneously driven. Accordingly, liquid droplet-ejecting characteristics are stabilized, and the unevenness of liquid droplet-ejecting characteristics can be reduced.

A third aspect of the present invention is the liquid jet head of the first or second aspect wherein the joint plate is a sealing plate having a piezoelectric element holding portion for sealing a space while ensuring the space in a region facing the piezoelectric elements.

In the third aspect, the head can be further miniaturized by mounting the driving ICs on the sealing plate.

A fourth aspect of the present invention is the liquid jet head of any one of the first to third aspects wherein a plurality of the driving ICs are placed on the joint plate at a predetermined interval in a direction in which the pressure generating chambers are arranged in a row; the penetrated holes are provided to correspond to the respective driving ICs; the beam portion is formed in a region on the joint plate, the region corresponding to the predetermined interval.

In the fourth aspect, the beam portion extending in the direction in which the pressure generating chambers are arranged in a row and the beam portion extending in the longitudinal direction of the pressure generating chambers, are formed. Thus, the rigidity of the sealing plate and the passage-forming substrate is further improved.

A fifth aspect of the present invention is a liquid jet apparatus including the liquid jet head of any one of the first to fourth aspects.

In the fifth aspect, printing quality is improved, and a small-sized liquid jet apparatus can be realized.

DESCRIPTION OF THE PREFERRED EMBODIMENTS

Hereinafter, the present invention will be described in detail based on embodiments.

(Embodiment 1)

Figure 1:
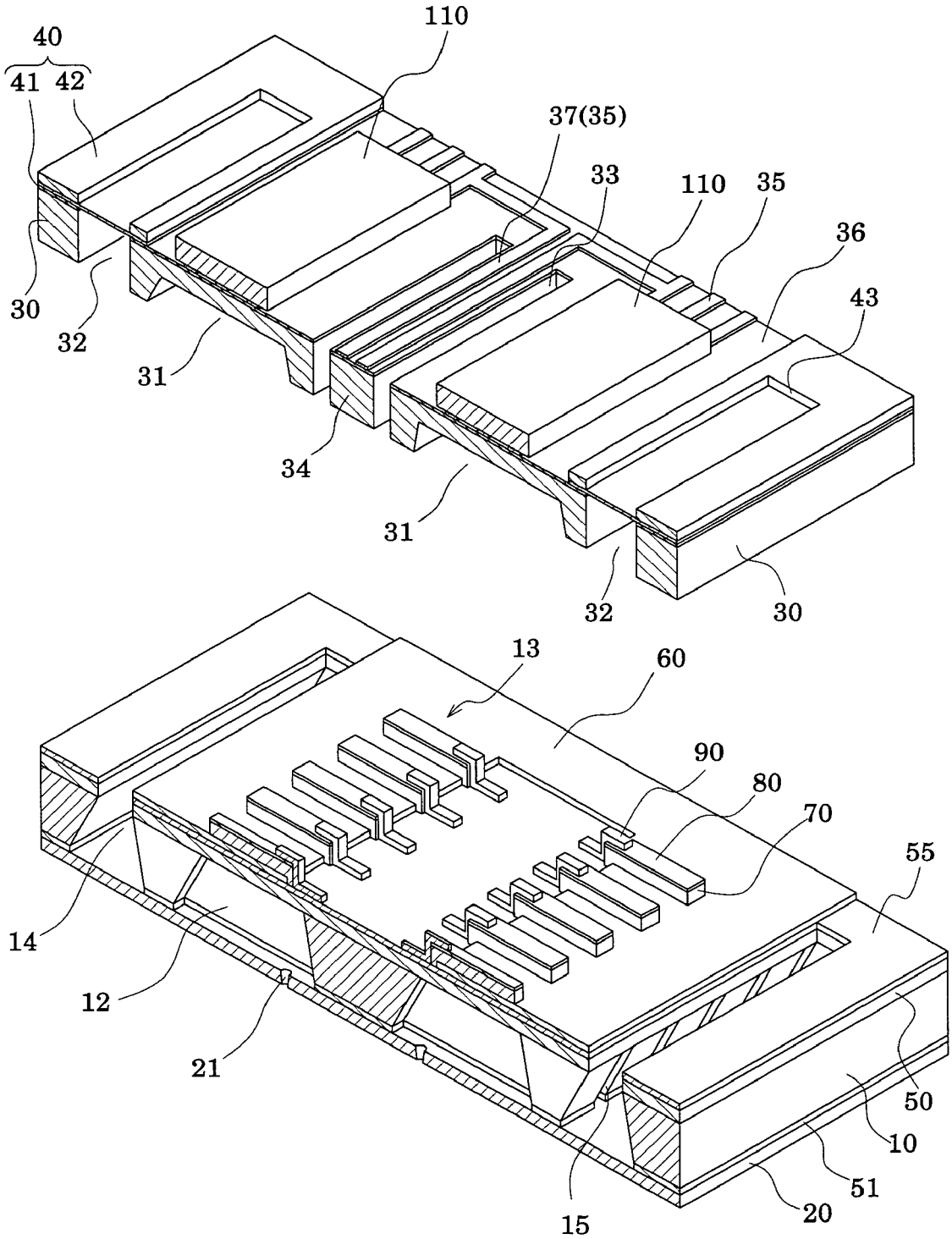
FIG. 1 is an exploded perspective view of a recording head according to Embodiment 1.
Figure 2A:
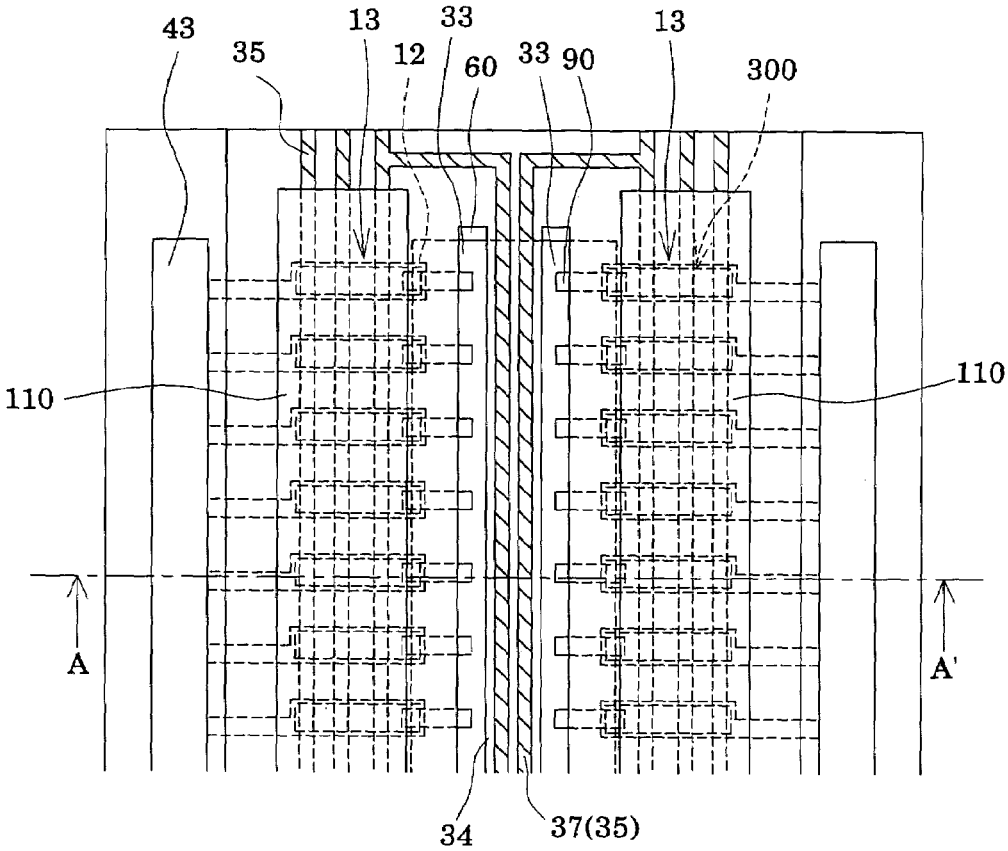
FIGS. 2A and 2B are a plan view and a cross-sectional view, respectively, of the recording head according to Embodiment 1.
Figure 2B:
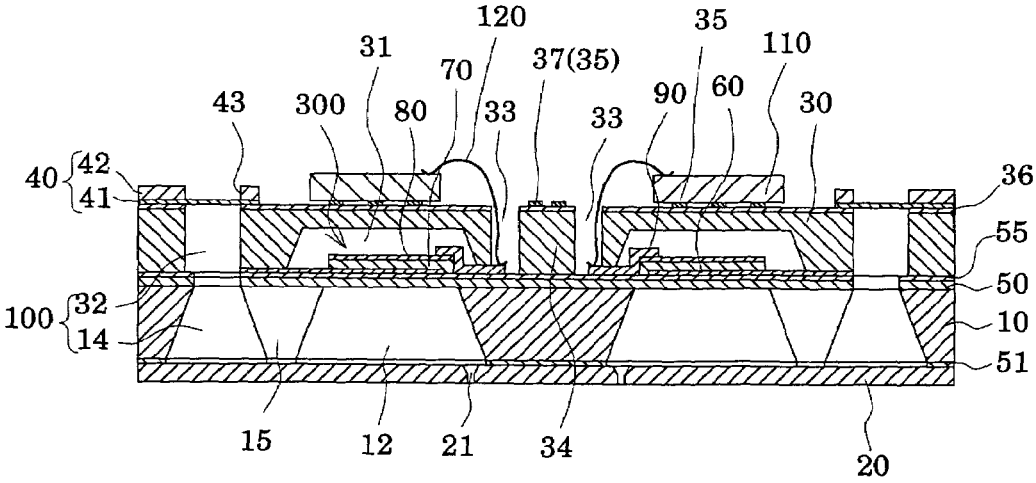

FIG. 1 is an exploded perspective view showing an ink jet recording head according to Embodiment 1 of the present invention. FIGS. 2A and 2B are a plan view and a cross-sectional view of FIG. 1, respectively. As shown in these drawings, in the present embodiment, a passage-forming substrate 10 is made of a single crystal silicon substrate with (110) plane orientation. An elastic film 50 which is made of silicon dioxide previously formed by thermal oxidation and which has a thickness of 1 to 2 μm, is formed on one surface of the passage-forming substrate 10. Two rows 13 each of which has a plurality of pressure generating chambers 12 arranged in a row in the width direction thereof, are formed in the passage-forming substrate 10. Moreover, communicating portions 14 are formed in the passage-forming substrate 10, in regions outside the pressure generating chambers 12 in the longitudinal direction thereof. The communicating portions 14 and the pressure generating chambers 12 are made to communicate with each other through ink supply paths 15, which are provided for the respective pressure generating chambers 12. Incidentally, each of the communicating portions 14 communicates with a reservoir portion in a sealing plate (to be described later) to constitute part of a reservoir, which is an ink chamber common to the pressure generating chambers 12. The ink supply paths 15 are formed to have smaller widths than the widths of the pressure generating chambers 12. Thus, the passage resistance of ink flowing into the pressure generating chambers 12 from the communicating portions 14 is kept constant.

Moreover, a nozzle plate 20 is fixed to the opening surface side of the passage-forming substrate 10 with an insulation film 51 interposed therebetween, which has been used as a mask in forming the pressure generating chambers 12, by means of an adhesive agent, a thermowelding film, or the like. The nozzle plate 20 is perforated with nozzle orifices 21, which communicate with the vicinities of the opposite ends of the pressure generating chambers 12 to the ink supply paths 15. Note that the nozzle plate 20 is made of glass ceramic, a single crystal silicon substrate, stainless steel, or the like, having a thickness of, for example, 0.01 to 1 mm and a linear expansion coefficient of, for example, 2.5 to 4.5 ($\times 10^{-6}$/°C.) at 300° C. or less.

Meanwhile, on the opposite surface of the above-described passage-forming substrate 10 to the opening surface, the elastic film 50 having a thickness of, for example, approximately 1.0 μm is formed as described previously. An insulation film 55 having a thickness of, for example, approximately 0.4 μm is formed on the elastic film 50. Further, on the insulation film 55, a lower electrode film 60 having a thickness of, for example, approximately 0.2 μm, a piezoelectric layer 70 having a thickness of, for example, approximately 1.0 μm, and an upper electrode film 80 having a thickness of, for example, approximately 0.05 μm are formed and stacked by processes to be described later, and constitute each of piezoelectric elements 300. Here, a piezoelectric-element 300 is a portion including the lower electrode film 60, piezoelectric layer 70, and upper electrode film 80. In general, one electrodes of the piezoelectric elements 300 are formed as a common electrode, and the other electrodes and the piezoelectric layers 70 are formed by being patterned for the respective pressure generating chambers 12. Moreover, here, a portion which is constituted of one electrode formed by being patterned and the piezoelectric layer 70 and in which piezoelectric strain occurs due to the application of voltage to both the electrodes, is referred to as a piezoelectric active portion. In the present embodiment, the lower electrode film 60 is formed as a common electrode of the piezoelectric elements 300, and the upper electrode films 80 are formed as individual electrodes of the piezoelectric elements 300. However, even if they are reversed depending on a driving circuit or wiring, there will be no problems. In any case, the piezoelectric active portion is formed for each pressure generating chamber 12. Moreover, here, a piezoelectric element 300 and a vibration plate of which displacement occurs by driving the piezoelectric element 300 are collectively referred to as a piezoelectric actuator.

Moreover, a lead electrode 90 made of, for example, gold (Au) or the like is connected to the upper electrode film 80 included in each piezoelectric element 300. The lead electrode 90 is extended to a region corresponding to a region between the rows 13 of the pressure generating chambers 12. The tip of the lead electrode 90 is exposed in a penetrated hole in the sealing plate (to be described later).

Further, a joint plate (sealing plate 30 in the present embodiment) is joined to the top of the passage-forming substrate 10, where the above-described piezoelectric elements 300 are formed. On the sealing plate 30, driving ICs 110 for driving the piezoelectric elements 300 will be mounted. The sealing plate 30 has piezoelectric element holding portions 31 capable of sealing spaces in regions facing the piezoelectric elements 300, while ensuring enough space so that the movement of the piezoelectric elements 300 is not inhibited. The piezoelectric element holding portions 31 are provided to correspond to the respective rows 13 of the pressure generating chambers 12. Note that, although each piezoelectric element holding portion 31 is provided as one portion in the region corresponding to one row 13 of the pressure generating chambers 12 in the present embodiment, a piezoelectric element holding portion 31 may be independently provided for each piezoelectric element 300, as a matter of course. Materials for such a sealing plate 30 include, for example, glass, ceramic material, metal, resin, and the like. It is more preferable that the sealing plate 30 be made of a material having substantially the same thermal expansion coefficient as that of the passage-forming substrate 10. In the present embodiment, the sealing plate 30 is formed using a single crystal silicon substrate, which is the same material as that of the passage-forming substrate 10.

In the sealing plate 30, reservoir portions 32 are provided in regions corresponding to the communicating portions 14 of the passage-forming substrate 10. In the present embodiment, the reservoir portions 32 are formed along the rows 13 of the pressure generating chambers 12, penetrating the sealing plate 30 in the thickness direction thereof. As described previously, the reservoir portions 32 are made to communicate with the communicating portions 14 of the passage-forming substrate 10 to constitute reservoirs 100, which serve as ink chambers common to the pressure generating chambers 12.

In addition, in an approximately central portion of the sealing plate 30, i.e., in a region facing the region between the rows 13 of the pressure generating chambers 12, a penetrated hole 33 penetrating the sealing plate 30 in the thickness direction thereof is formed for each row 13 of the pressure generating chambers 12. Further, a beam portion 34 is formed between the penetrated holes 33. Note that the beam portion 34 is preferably formed to be integrated with the sealing plate 30. However, of course, the beam portion 34 may be a separate body from the sealing plate 30.

A wiring pattern 35 to which external interconnections (not shown) are connected to supply driving signals, is provided on the sealing plate 30 with an insulation film 36 interposed therebetween. Driving ICs 110, which are semiconductor integrated circuits (ICs) for driving the piezoelectric elements 300, are mounted on the wiring pattern 35 on both sides of the penetrated holes 33 of the sealing plate 30, i.e., in the regions corresponding to the respective rows 13 of the pressure generating chambers 12.

Here, the driving signals include various kinds of control signals such as a serial signal (SI) in addition to, for example, driver signals, such as a driving power signal, for driving driving ICs. The wiring pattern 35 includes a plurality of interconnections supplied with respective signals. In the present embodiment, out of the interconnections constituting the wiring pattern 35, common electrode interconnections 37, which are connected to the lower electrode film 60, the common electrode of the piezoelectric elements 300, and are supplied with a driving signal (COM), are extended along the rows 13 of the pressure generating chambers 12, in the regions where the driving ICs 110 are to be mounted and also on the beam portion 34. The interconnections provided on the beam portion 34 are not limited to the common electrode interconnections 37. Interconnections for supplying a serial signal or the like may be placed.

The driving ICs 110 mounted on the wiring pattern 35 and the lead electrodes 90 extended from the piezoelectric elements 300 are electrically connected to each other by connecting wires 120 which are made of conductive wires such as, for example, bonding wires, and which are extended in the penetrated holes 33 of the sealing plate 30. Similarly, the common electrode interconnections 37 of the wiring pattern 35 and the lower electrode film 60 are electrically connected to each other by connecting wires 120 in the vicinities of both ends of the penetrated holes 33.

In the above-described structure of the present embodiment, the penetrated holes 33 are provided for the respective rows 13 of the pressure generating chambers 12, in the region of the sealing plate 30 facing the region between the rows 13 of the pressure generating chambers 12. The lead electrodes 90 and the driving ICs 110, or the lower electrode film 60 and the common electrode interconnections 37 are electrically connected by the connecting wires 120 extended in the penetrated holes 33. Accordingly, the sealing plate 30 can be limited to a relatively small area. In addition, by forming the cross section of the beam portion 34 into a tapered shape, the rigidity of the sealing plate 30 and the passage-forming substrate 10 can be further improved, and a capillary in wire-bonding can be prevented from coming in contact with the beam portion 34.

Moreover, since the beam portion 34 is formed between the penetrated holes 33, the rigidity (strength) of the sealing plate 30 is improved. Along with this, the rigidity of the passage-forming substrate 10 to which the sealing plate 30 is joined is also improved. Accordingly, the occurrence of crosstalk due to low rigidity of the passage-forming substrate 10 can be prevented. Thus, favorable ink jet characteristics can be obtained. Further, the improvement of the rigidity of the sealing plate 30 and the passage-forming substrate 10 prevents damage due to external forces applied, for example, in capping or the like, thus making it possible to improve durability and reliability.

Furthermore, since the common electrode interconnections 37 are provided on the beam portion 34 of the sealing plate 30, and therefore the area of the common electrode interconnections 37 is wide, the ohmic value of the lower electrode film 60 connected to the common electrode interconnections 37 is substantially decreased. That is, since the current-carrying capacity of the lower electrode film 60 can be ensured, a voltage drop does not occur even when the plurality of piezoelectric elements 300 are simultaneously driven. Accordingly, the occurrence of crosstalk due to a voltage drop can also be prevented.

Incidentally, a compliance plate 40 constituted of a sealing film 41 and a fixing plate 42 is joined to the top of the above-described sealing plate 30. Here, the sealing film 41 is made of a flexible material with low rigidity (e.g., a polyphenylene sulfide (PPS) film having a thickness of 6 μm). One sides of the reservoir portions 31 are sealed with this sealing film 41. Further, the fixing plate 42 is made of a hard material, such as metal (e.g., stainless steal (SUS) ortho like having a thickness of 30 μm). Regions of the fixing plate 42, the regions facing the reservoirs 100, are opening portions 43 where the fixing plate 42 is completely removed in the thickness direction. Accordingly, one sides of the reservoirs 100 are sealed with only the flexible sealing film 41.

In the ink jet recording head of the present embodiment as described above, ink is supplied from external ink supply means (not shown), and the inside from the reservoirs 100 to the nozzle orifices 21 is filled with the ink. Thereafter, voltage is applied between the lower and upper electrode films 60 and 80 corresponding to the respective pressure generating chambers 12 in accordance with record signals from the driving circuits 110, thereby flexibly deforming the elastic film 50, the insulation film 55, the lower electrode film 60, and the piezoelectric layers 70. Thus, the pressures in the respective pressure generating chambers 12 are increased, and ink droplets are ejected from the nozzle orifices 21.

(Embodiments 2)

Figure 3:
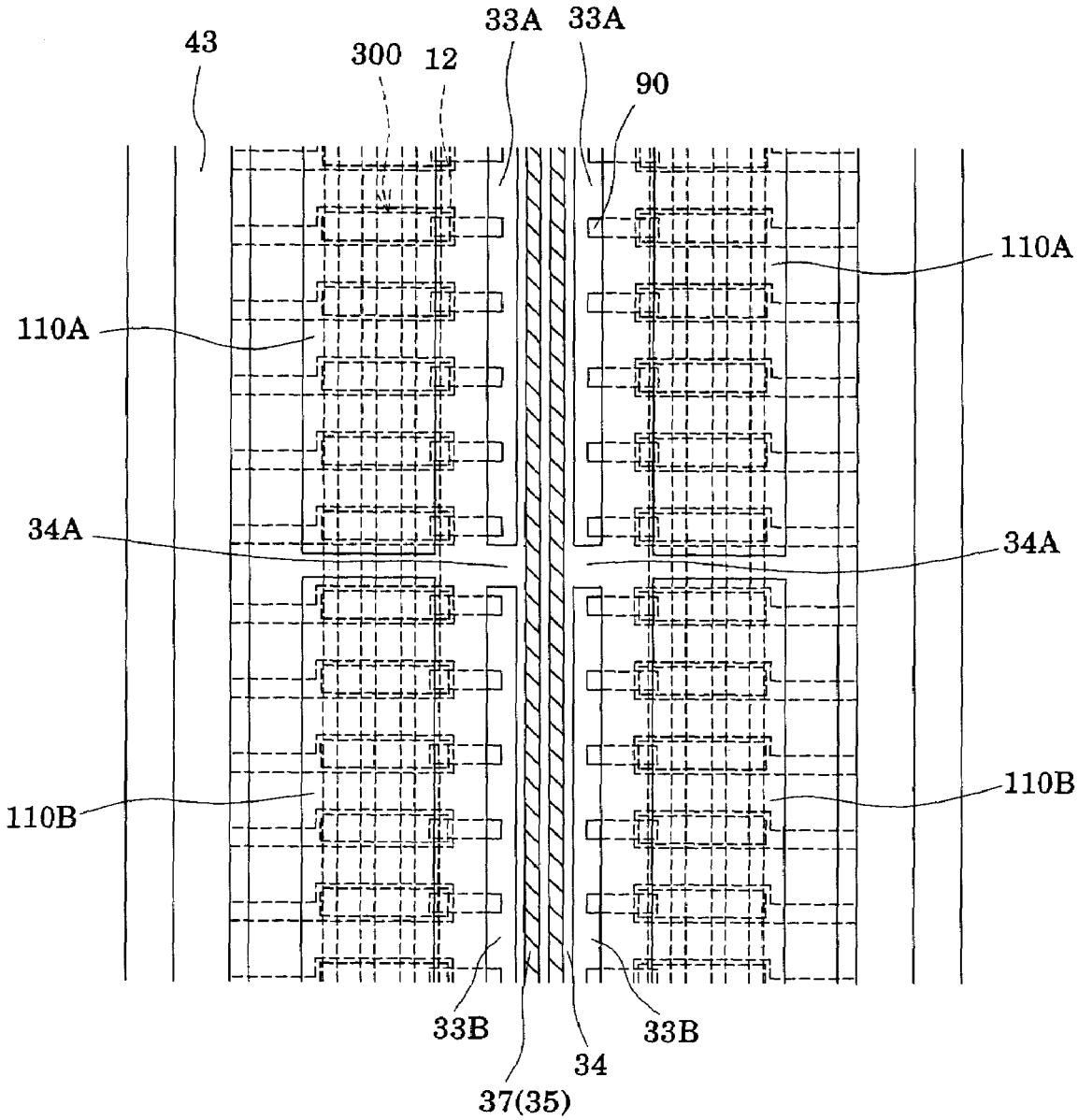
FIG. 3 is a plan view of a recording head according to Embodiment 2.

FIG. 3 is a plan view of an ink jet recording head according to Embodiment 2. As shown in FIG. 3, in the present embodiment, two penetrated holes 33A and 33B are provided for each row 13 of the pressure generating chambers 12, and a beam portion 34A is also formed between the two penetrated holes 33A and 33B. That is, in the present embodiment, two driving ICs 110A and 110B are mounted on the sealing plate 30, in each of the regions facing the rows 13 of the pressure generating chambers 12, and thus four driving ICs 110 in total are mounted. The present embodiment is the same as Embodiment 1, except that the penetrated holes 33A and 33B are provided for the respective driving ICs 110 and that the beam portion 34A is formed between each pair of the two penetrated holes 33A and 33B to be integrated with the sealing plate 30 using the same member thereof.

Such a structure also provides the same effects as Embodiment 1. Moreover, forming the beam portions 34A makes it possible to further improve the rigidity of the sealing plate 30 and the passage-forming substrate 10 and to more reliably prevent the occurrence of crosstalk.

Other Embodiments

Embodiments of the present invention have been described above. However, the basic structures of ink jet recording heads are not limited to the above-described ones. For example, the sealing plate 30 having the piezoelectric element holding portions 31 has been taken as an example of a joint plate in the foregoing embodiments. However, the joint plate is not particularly limited as long as it is a plate on which driving ICs can be mounted. Further, for example, in the foregoing embodiments, a thin film-type ink jet recording head manufactured by applying deposition and lithography processes has been taken as an example. However, of course, the present invention is not limited to this. For example, the present invention can also be adopted in a thick film-type ink jet recording head formed by a method of adhering a green sheet, or the like.

Figure 4:
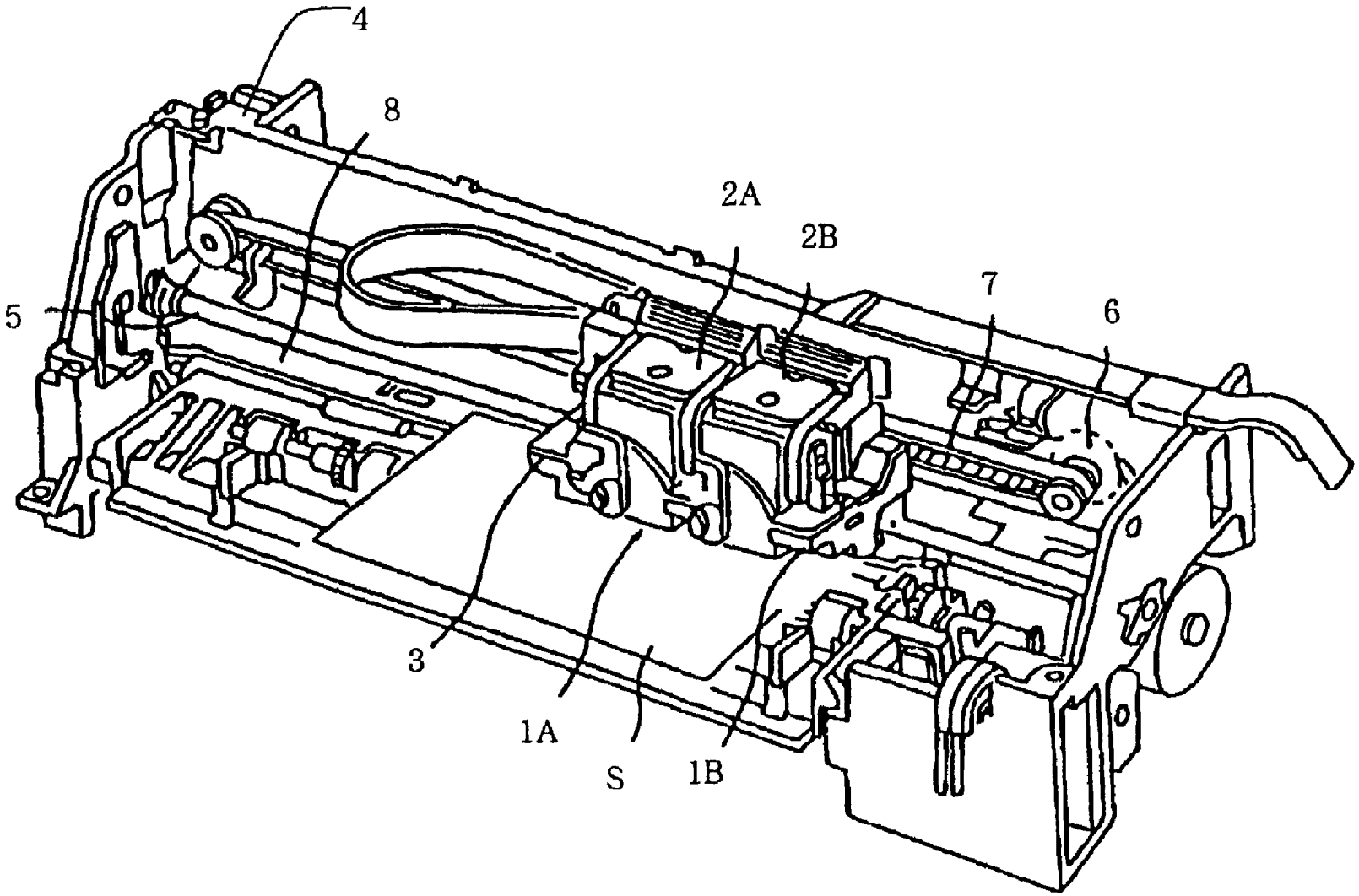
FIG. 4 is a schematic diagram of a recording apparatus according to one embodiment.

In addition, each of the ink jet recording heads of these embodiments constitutes part of a recording head unit provided with an ink passage communicating with an ink cartridge or the like, and is mounted in an ink jet recording apparatus. FIG. 4 is a schematic diagram showing an example of the ink jet recording apparatus. As shown in FIG. 4, cartridges 2A and 2B constituting ink supply means are detachably provided to recording head units 1A and 1B, each having the ink jet recording head. A carriage 3 on which the recording head units 1A and 1B are mounted is provided on a carriage shaft 5, which is attached to an apparatus body 4, to be movable in the axial direction of the carriage shaft 5. The recording head units 1A and 1B are assumed to eject, for example; a black ink composition and a color ink composition, respectively. Further, the driving force of a drive motor 6 is transmitted to the carriage 3 through a plurality of gears (not shown) and a timing belt 7, whereby the carriage 3 having the recording head units 1A and 1B mounted thereon is moved along the carriage shaft 5. On the other hand, a platen 8 is provided in the apparatus body 4, along the carriage shaft 5. A recording sheet S, which is a recording medium such as paper fed by a paper feeding roller (not shown) or the like, is carried on the platen 8.

Note that, although the ink-jet recording head has been described as an example of a liquid jet head of the present invention in the foregoing embodiments, the basic structure of the liquid jet head is not limited to the aforementioned ones. The present invention widely covers liquid jet heads in general. It is needless to say that the present invention can also be applied to those which jet liquid other than ink. Other liquid jet heads include, for example: various kinds of recording heads used in image recording apparatuses such as printers; color material jet heads used for manufacturing color filters of liquid crystal displays and the like; electrode material jet heads used for forming electrodes of organic EL displays, field emission displays (FEDs), and the like; and bio-organic matter jet-heads used for manufacturing biochips.

What is claimed is:

1. A liquid jet head comprising: a passage-forming substrate including at least two rows of pressure generating chambers, each communicating with a nozzle orifice;

piezoelectric elements for causing pressure change in the pressure generating chambers, the piezoelectric elements being provided on one side of the passage-forming substrate with a vibration plate interposed therebetween;

a joint plate joined to the piezoelectric element side of the passage-forming substrate; and driving ICs for driving the piezoelectric elements, the driving ICs being provided in regions on the joint plate, the regions facing the respective rows of the pressure generating chambers, wherein in the joint plate, at least one penetrated hole, in which lead electrodes led from the piezoelectric elements are exposed, is provided for each row of the pressure generating chambers in a region corresponding to a region between the rows of the pressure generating chambers, and a beam portion is formed between the adjacent penetrated holes.

2. The liquid jet head according to claim 1, wherein a wiring pattern on which the driving ICs are to be mounted is formed on the joint plate, and a common electrode interconnection constituting part of the wiring pattern is formed along the row of the pressure generating chambers, on the beam portion, the common electrode interconnection being connected to a common electrode common to the plurality of piezoelectric elements arranged parallel to each other.

3. The liquid jet head according to claim 1, wherein the joint plate is a sealing plate having a piezoelectric element holding portion for sealing a space while ensuring the space in a region facing the piezoelectric elements.

4. The liquid jet head according to claim 1, wherein a plurality of the driving ICs are placed on the joint plate at a predetermined interval in a direction in which the pressure generating chambers are arranged in a row, the penetrated holes are provided to correspond to the respective driving ICs, and the beam portion is formed in a region on the joint plate, the region corresponding to the predetermined interval.

5. A liquid jet apparatus comprising the liquid jet head according to any one of claims 1 to 4.

* * * * *